US012599258B2

(12) United States Patent
Chen et al.

(10) Patent No.: US 12,599,258 B2
(45) Date of Patent: Apr. 14, 2026

(54) SUPPORT ELEMENT ASSEMBLY

(71) Applicant: Amplifi Tech (Xiamen) Limited, Xiamen (CN)

(72) Inventors: Sheng-Fa Chen, Nanan City (CN); Feng-Ming Chen, Xiamen City (CN); Zhi-Min Shao, Xiamen City (CN)

(73) Assignee: Amplifi Tech (Xiamen) Limited, Xiamen (CN)

( * ) Notice: Subject to any disclaimer, the term of this patent is extended or adjusted under 35 U.S.C. 154(b) by 685 days.

(21) Appl. No.: 17/986,192

(22) Filed: Nov. 14, 2022

(65) Prior Publication Data

US 2024/0164555 A1 May 23, 2024

(51) Int. Cl.
*A47G 9/10* (2006.01)

(52) U.S. Cl.
CPC ..... *A47G 9/1045* (2013.01)

(58) Field of Classification Search
CPC ..... A47G 9/1045; A47G 9/1009; A47G 9/10
USPC ... 5/636, 648, 630, 632, 652, 722, 723, 640, 5/692, 727, 740
See application file for complete search history.

(56) References Cited

U.S. PATENT DOCUMENTS

| | | | | |
|---|---|---|---|---|
| 5,953,779 | A * | 9/1999 | Schwartz | A47C 27/001 5/722 |
| 2005/0223493 | A1* | 10/2005 | Setokawa | A61F 7/02 5/636 |
| 2017/0120157 | A1* | 5/2017 | Ochi | A47B 47/047 |
| 2020/0205589 | A1* | 7/2020 | Ho | A61F 5/56 |
| 2022/0338639 | A1* | 10/2022 | Smidel | A61G 7/0755 |
| 2022/0408945 | A1* | 12/2022 | Manuszak | A47C 27/20 |

FOREIGN PATENT DOCUMENTS

| | | | |
|---|---|---|---|
| CN | 203244185 | U | 10/2013 |
| CN | 210471745 | U | 5/2020 |
| CN | 210932396 | U | 7/2020 |
| CN | 113211797 | A | 8/2021 |
| CN | 113893125 | A | 1/2022 |

* cited by examiner

*Primary Examiner* — Justin C Mikowski
*Assistant Examiner* — Deborah Talitha Gedeon
(74) *Attorney, Agent, or Firm* — Cooper Legal Group, LLC

(57) ABSTRACT

A support element assembly includes at least two types of standard blocks. The standard blocks are connected to each other and selected from the group consisting of a first standard block having a first elastic constant and a first height, a second standard block having a second elastic constant and the first height, a third standard block having the first elastic constant and a second height, and a fourth standard block having the second elastic constant and the second height. The standard blocks are manufactured by 3D printing and have identical lattices, and each standard block has a jointing structure.

20 Claims, 8 Drawing Sheets

(B)

(A) 100'

SUPPORT ELEMENT ASSEMBLY

BACKGROUND OF THE DISCLOSURE

1. Field of the Disclosure

The present disclosure relates to a support element assembly, and in particular to a support element assembly capable of being modularized.

2. Description of the Related Art

Household supplies such as chairs, beds, pillows, and shoes, each have therein a support structure for supporting a load and allowing the household supplies to have appropriate support strength.

For example, CN203244185U discloses a composite dual-height pillow formed by coupling together different fundamental pillow blocks and external components (for example, buttons). However, the fundamental pillow blocks are made of a foamed material rather than formed by three-dimensional (3D) printing; as a result, the fundamental pillow blocks neither have any lattice structure nor exhibit advantages of adjustable softness and being easy to clean.

Furthermore, CN113211797A discloses a sponge structure formed by 3D printing and capable of adjusting softness and deformation directions. However, the sponge structure is an integral structure obtained by 3D printing a sketch model, which is generated according to the basic units determined by set load criteria. Therefore, the sponge structure does not have unit structures capable of being jointed to each other.

BRIEF SUMMARY OF THE DISCLOSURE

Although the style designs of pillows and the materials which the pillows are made of vary from pillow manufacturer to pillow manufacturer, the pillows thus manufactured and marketed mostly come in single specifications, i.e., each pillow possesses fixed dimensions and identical physical properties such as weight, resilience, and softness. Therefore, different users with various needs are restrained when shopping for and using the pillows.

For the sake of customization, some pillow manufacturers attempted to manufacture a pillow in its entirety by 3D printing and adjust parameters such as structure density and strut dimensions in the printing sketch, with a view to manufacturing a heterogeneous pillow. However, manufacturing of large pillows by 3D printing requires a machine with a large processing chamber or processing platform, which increases the production cost. Moreover, as the manufactured pillows become larger, the internal defects caused by low production yield during printing make more differences. When the users feel that the pillows are unbreathable, have bad touch, or are dirty, it will be difficult to take out, replace, or rinse the interior of an integrally-formed structure.

Therefore, it is an objective of the disclosure to provide a modularized support element assembly capable of meeting different usage needs and carrying out local adjustment.

The disclosure provides a support element assembly including at least two types of standard blocks. The standard blocks are connected to each other and selected from a group consisting of a first standard block having a first elastic constant and a first height, a second standard block having a second elastic constant and the first height, a third standard block having the first elastic constant and a second height, and a fourth standard block having the second elastic constant and the second height. The standard blocks are manufactured by 3D printing and have identical lattices, and each standard block has a jointing structure.

Therefore, the support element assembly of the disclosure is characterized by coupling together different standard blocks to achieve customization, thereby meeting different usage needs. Moreover, since the standard blocks can be demounted or connected by the jointing structures, portions of the standard blocks can be changed or adjusted quickly to carry out local adjustment.

Features and advantages of the disclosure are hereunder illustrated with embodiments, depicted with accompanying drawings, and described below.

DETAILED DESCRIPTION OF THE DISCLOSURE

Figure 1:
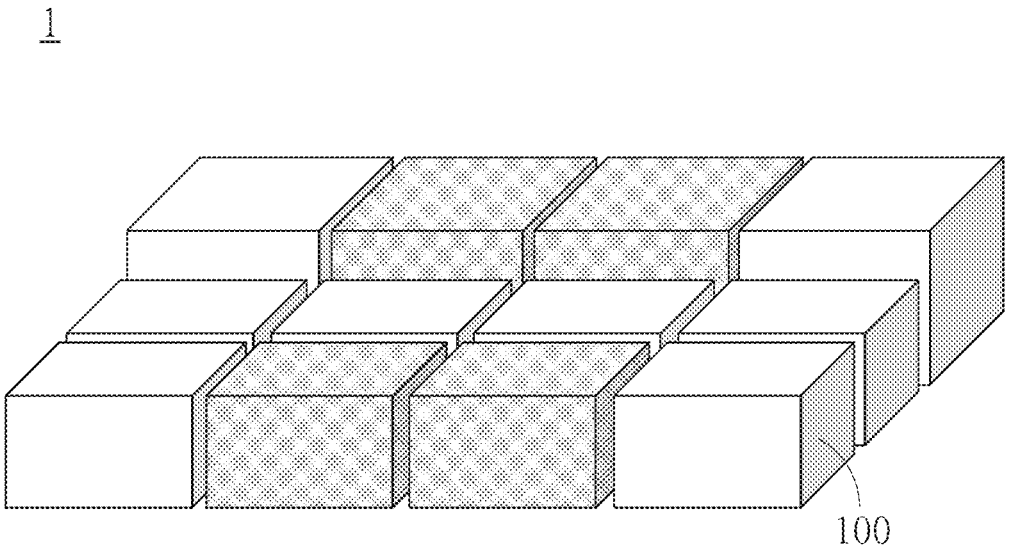
FIG. 1 is a perspective schematic view of a support element assembly according to an embodiment of the disclosure.

The aforesaid and other technical features and advantages of the disclosure are depicted by accompanying drawings, illustrated with preferred embodiments, and described below. Direction-related terms, such as over, under, left, right, front, and back, used herein are merely intended for use in conjunction with the accompanying drawings. Therefore, the direction-related terms are illustrative rather than restrictive of the disclosure. Moreover, in the embodiments below, identical or similar components are denoted by identical or similar reference numerals.

Figure 2A:
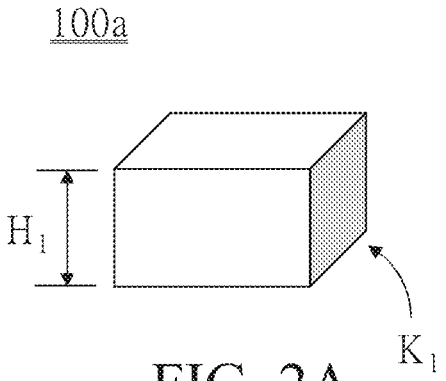
FIG. 2A is a perspective schematic view of a first standard block.
Figure 2B:
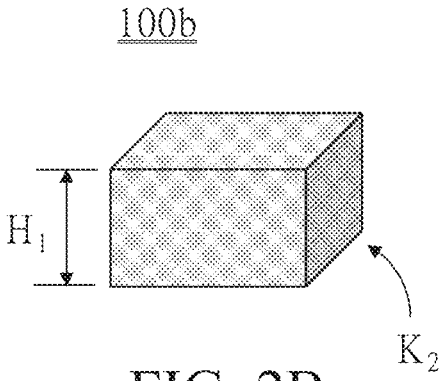
FIG. 2B is a perspective schematic view of a second standard block.
Figure 2C:
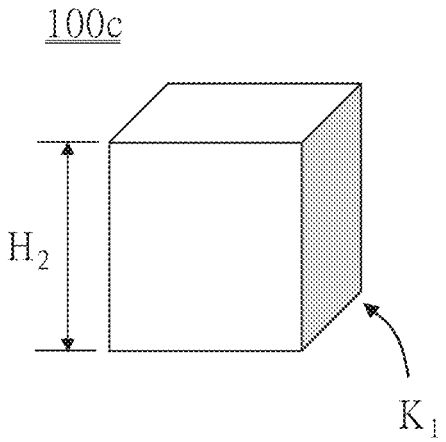
FIG. 2C is a perspective schematic view of a third standard block.
Figure 2D:
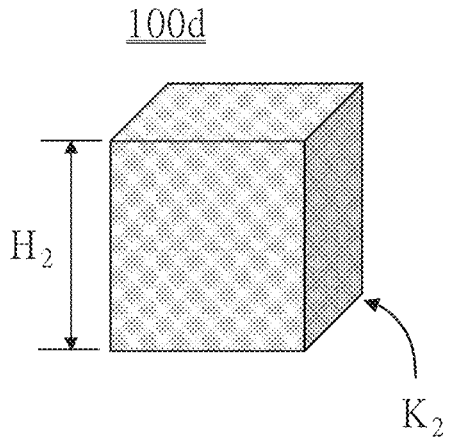
FIG. 2D is a perspective schematic view of a fourth standard block.

Refer to FIG. 1 and FIGS. 2A-2D. FIG. 1 is a perspective schematic view of a support element assembly 1 according to an embodiment of the disclosure. FIG. 2A is a perspective schematic view of a first standard block. FIG. 2B is a perspective schematic view of a second standard block. FIG. 2C is a perspective schematic view of a third standard block. FIG. 2D is a perspective schematic view of a fourth standard block. In this embodiment, the support element assembly 1 is, for example, applicable to an internal support structure of a pillow. Alternatively, the support element assembly 1 is also applicable to elements which require considerations to be given to both a support strength and a contact comfort level, such as insoles, cushions, backrests, and linings, which is not limited thereto. The support element assembly 1 includes at least two types of standard blocks 100. The standard blocks 100 are connected to each other and selected from the group consisting of a first standard block 100*a* having a first elastic constant $K_1$ and a first height $H_1$, a second standard block 100*b* having a second elastic constant $K_2$ and the first height $H_1$, a third standard block 100*c* having the first elastic constant $K_1$ and a second height $H_2$, and a fourth standard block 100*d* having the second elastic constant $K_2$ and the second height $H_2$.

To allow for the required amount of deformation related to head shape or different body parts of users, the support element assembly 1 includes at least two different types of standard blocks 100. The standard blocks 100 are different, for example, in terms of height and/or elastic constant. In an embodiment, the first elastic constant $K_1$ ranges, for example, from 3-15 N/mm, whereas the second elastic constant $K_2$ ranges, for example, from 10-40 N/mm. This embodiment is exemplified by the first elastic constant $K_1$ of 5.03 N/mm and the second elastic constant $K_2$ of 33.46 N/mm. In other words, under identical loads, the first standard block 100*a* and the third standard block 100*c* with the first elastic constant $K_1$ have greater amount of deformation than the second standard block 100*b* and the fourth standard blocks 100*d* with the second elastic constant $K_2$. The findings of experiments conducted in connection with the disclosure show that, despite their respective ongoing deformations, the standard blocks 100 will still be firmly connected and thus will not detach if the ratio of the first elastic constant $K_1$ to the second elastic constant $K_2$ ranges from 0.075 to 1.5. Thus, owing to mutual connection of the second standard block 100*b* and the fourth standard block 100*d* with strong stiffness and the first standard block 100*a* and the third standard block 100*c* with low stiffness, the support element assembly 1 meets requirements for contacting different parts of bodies of users or for different uses.

In this embodiment, the standard blocks 100 are, for example, resilient foamed blocks manufactured by a three-dimensional (3D) printing process. The 3D printing process is, for example, a DLP (Direct Light Processing) photocuring 3D printing process, using a material such as extruded polyurethane (EPU). Therefore, the standard blocks 100 thus printed out are advantageously porous, lightweight, soundproof, impact-resistant, and shock-proof. However, the standard blocks 100 are not limited thereto. Other optional resilient materials or foamed materials may be chosen according to different applicable products, and other optional 3D printing technology such as SLA (stereolithography) and LCD (liquid crystal display) may be used according to precision and cost.

Figure 3:
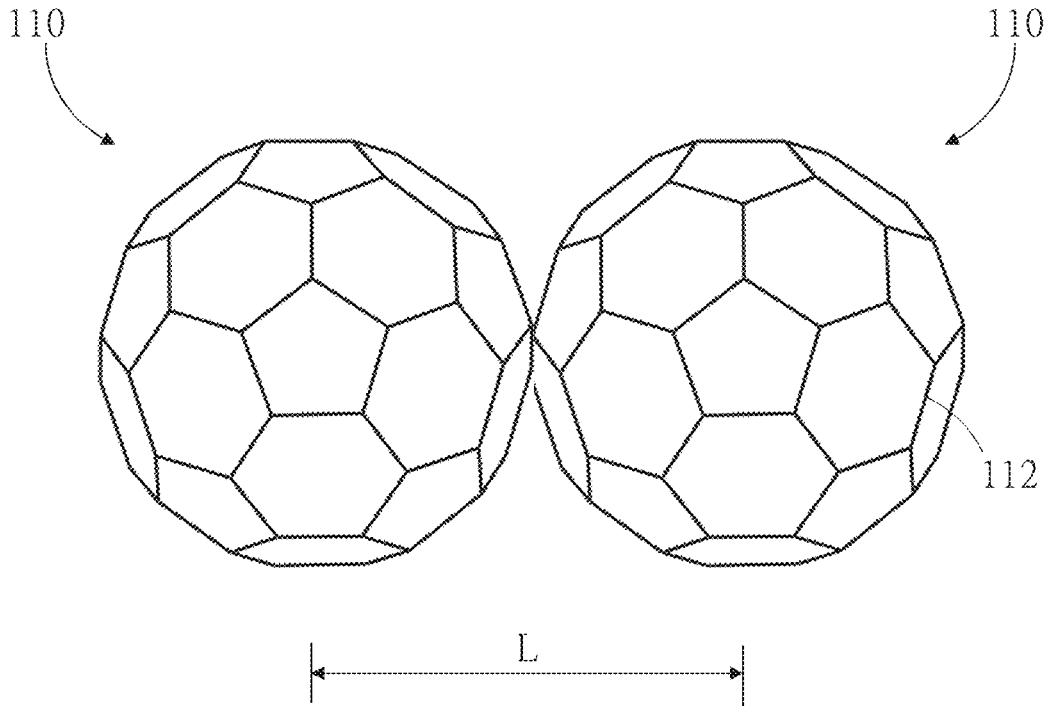
FIG. 3 is a perspective schematic view of two adjacent lattices in a standard block.
Figure 4:
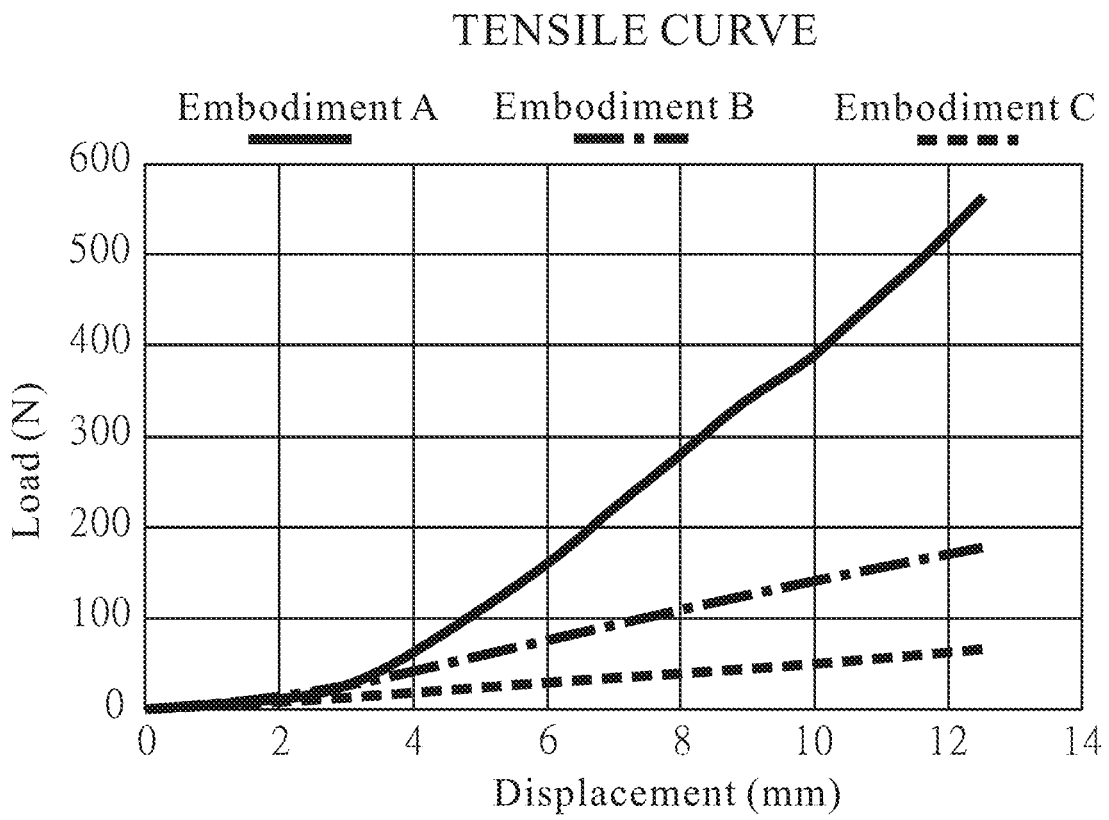
FIG. 4 is a tensile curve graph of standard blocks in embodiments A-C of the disclosure.

Refer to FIG. 3 and FIG. 4. FIG. 3 is a perspective schematic view of two adjacent lattices in a standard block shown in FIG. 1. FIG. 4 is a tensile curve graph of standard blocks in embodiments A-C of the disclosure, showing three respective tensile curves. The standard blocks 100 thus manufactured by the 3D printing process have substantially identical lattices 110. The lattices 110 are substantially identical because the lattices 110 have identical crystalline structure (for example, face-centered cubic, body-centered cubic, and six-sided cubic) and similar lattice dimension L and lattice struts 112. In this embodiment, the lattice dimension L of the lattices 110, for example, equals 9.5 mm, and is defined as the distance between the centers of two adjacent lattices 110. In some other embodiments, the lattice dimension L ranges from 8.5 to 10 mm. In this embodiment, the diameter of the lattice struts 112, for example, equals 0.95 mm. In some other embodiments, the diameter of the lattice struts 112 ranges from 0.9 to 1.0 mm. By altering the lattice dimension L and the diameter of the lattice struts 112, adjustments of the first elastic constant $K_1$ and the second elastic constant $K_2$ can be achieved and are depicted by Table 1 below.

TABLE 1

| | Soft | Moderate | Firm |
|---|---|---|---|
| Lattice Dimension (mm) | 10 | 9.5 | 8.5 |
| Lattice Strut Diameter (mm) | | 0.95 | |
| Height (cm) | | 4-10 | |
| Material | | EPU 41/43 | |
| Elastic Constant (N/mm) | 5.03 | 11.76 | 33.46 |

When the support element assembly 1 is compressed or stretched in all directions, the substantially identical lattices 110 of the standard blocks 100 transmit the load evenly to the whole support structure, rendering the amount of deformation homogeneous and continuous in all directions. Moreover, the 3D printing process not only allows finished products to be quickly manufactured, but the products are lightweight because of gaps between the lattice struts 112. In addition, the finished products are of high precision. Therefore, the finished products offer good user experience.

Figure 5B:
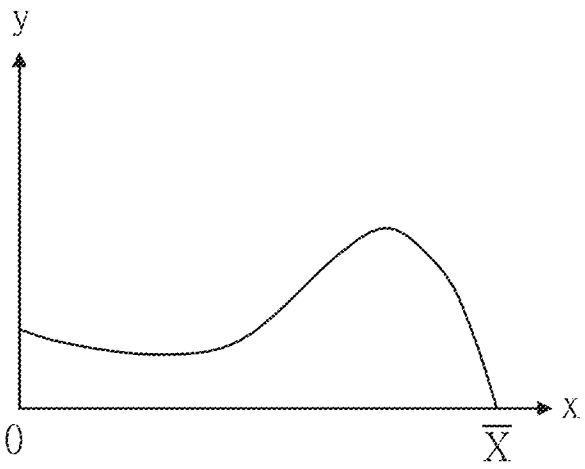
FIG. 5B is a y-x graph depicting an outline of the standard block.
Figure 5A:
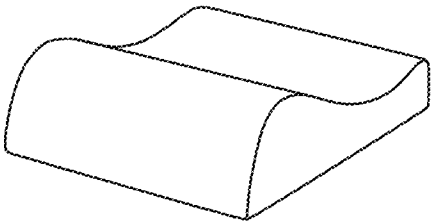
FIG. 5A is a perspective schematic view of a standard block of the support element assembly according to another embodiment of the disclosure.

Refer to FIGS. 5A-5B, where FIG. 5A is a perspective schematic view of a standard block of the support element assembly according to another embodiment of the disclosure, and FIG. 5B is a y-x graph depicting the outline of the standard block. Unlike the embodiment illustrated by FIG. 2, the embodiment illustrated by FIGS. 5A-5B are characterized in that the top surface of the standard block 100' is not flat but has at least a curved outline, as shown in FIG. 5A.

With the standard blocks 100' being connected to each other, the top surface of each standard block 100' can be flat, oblique, curved (including convex and concave), or a combination thereof, but the disclosure is not limited thereto. The first standard height $H_1$ is defined as the average distance between the top surface and the bottom surface of the first standard block 100*a* or the second standard block 100*b*, whereas the second standard height $H_2$ is defined as the average distance between the top surface and the bottom surface of the third standard block 100*c* or the fourth standard block 100*d*, with the bottom surface being a standard surface defined on the standard block and adapted to mount the standard block in place, and the top surface being an upper surface defined on the standard block and adapted to come into contact with a body of the user. In this embodiment, when the lateral outline of the standard block 100' is depicted against x-axis and y-axis, the height of the standard block 100' is mathematically expressed as follows:

$$\frac{\int_0^{\overline{X}} y\,dx}{\overline{X}},$$

where x-axis and y-axis are axes in the Cartesian coordinate system, and $\overline{X}$ denotes the length of the standard block 100' in the width direction. Therefore, with the standard blocks 100' being connected to each other, the upper surface of the support element assembly 1 is not necessarily presented in the form of a plurality of flat surfaces adjoined to each other, but the upper surface of the support element assembly 1 may also be presented in the form of a combination of different curved surfaces and oblique surfaces, and even in a seamless way to further enhance the comfort level of the support element assembly 1 in use.

In another embodiment, the support element assemblies 1 are disposed in different components of the same object, respectively, to serve supportive and cushioning purposes. For instance, a pillow which the support element assembly 1 is applicable to includes a head pillow for supporting a head of the user and a shoulder pillow for supporting the shoulders of the user. By adjusting the types of the standard blocks 100 for use in the head pillow and shoulder pillow and altering the heights of the head pillow and shoulder pillow, it is feasible to obtain the comfort ratings shown in Table 2 below.

TABLE 2

| | Embodiment 1 | Embodiment 2 | Embodiment 3 | Embodiment 4 | Embodiment 5 | Embodiment 6 | Embodiment 7 | Embodiment 8 | Embodiment 9 |
|---|---|---|---|---|---|---|---|---|---|
| Pillow Height (cm) | 4 | 8 | 12 | 4 | 8 | 12 | 4 | 8 | 12 |
| Pillow Width (cm) | 14 | 16 | 18 | 14 | 16 | 18 | 14 | 16 | 18 |
| Pillow Stiffness | | Soft | | | Moderate | | | Firm | |
| Shoulder Pillow Height (cm) | 2 | 2 | 4 | 2 | 2 | 4 | 2 | 2 | 4 |
| Shoulder Pillow Width (cm) | 8 | 8 | 12 | 8 | 8 | 12 | 8 | 8 | 12 |
| Shoulder Pillow Stiffness | Moderate | Firm | Moderate | Soft | Firm | Soft | Soft | Moderate | Soft |
| Material | | | | | EPU 41 | | | | |
| Comfort Level | Very low | High | Low | Very low | Very high | Very high | Very low | High | High |

As indicated by the results shown in Table 2, comfort levels of users are neither solely determined by the stiffness of the head pillow and shoulder pillow nor solely determined by the difference in height between the head pillow and shoulder pillow. Instead, an appropriate combination of the two parameters is required in order for a desirable comfort level to be obtained. This further confirms the necessity for the support element assembly 1 to include at least two different standard blocks 100 connected to each other.

The findings of experiments conducted in connection with the disclosure show the following phenomenon: when the absolute value of the slope of an upper surface (i.e., the surface in contact with a head and shoulders of the user) of the support element assembly 1 is not greater than 0.75, that is, the support element assembly 1 has a smooth upper surface, the user does not perceive any obvious height difference or protuberance in the vicinity of the head and shoulders of the user, thereby enhancing the comfort level of the user.

In a feasible embodiment, the support element assembly 1 is composed of a single layer of standard blocks 100 in the height direction, as shown in FIG. 1. The first height $H_1$ is less than the second height $H_2$. The difference between the first height $H_1$ and the second height $H_2$ is not greater than 75% of the second height $H_2$. Thus, in this embodiment, the height of the support element assembly 1 directly depends on the first height $H_1$ and the second height $H_2$, whereas the top surfaces of the first standard block 100*a* and the second standard block 100*b* with the first height $H_1$ and the third standard block 100*c* and the fourth standard block 100*d* with the second height $H_2$ combine to form the upper surface of the support element assembly 1. Therefore, if one of the standard blocks 100 has an internal defect (for example, the lattice struts 112 sever) or needs to be washed, the users can immediately demount the standard block to replace or wash the standard block rather than replacing or washing all the standard blocks.

Figure 6:
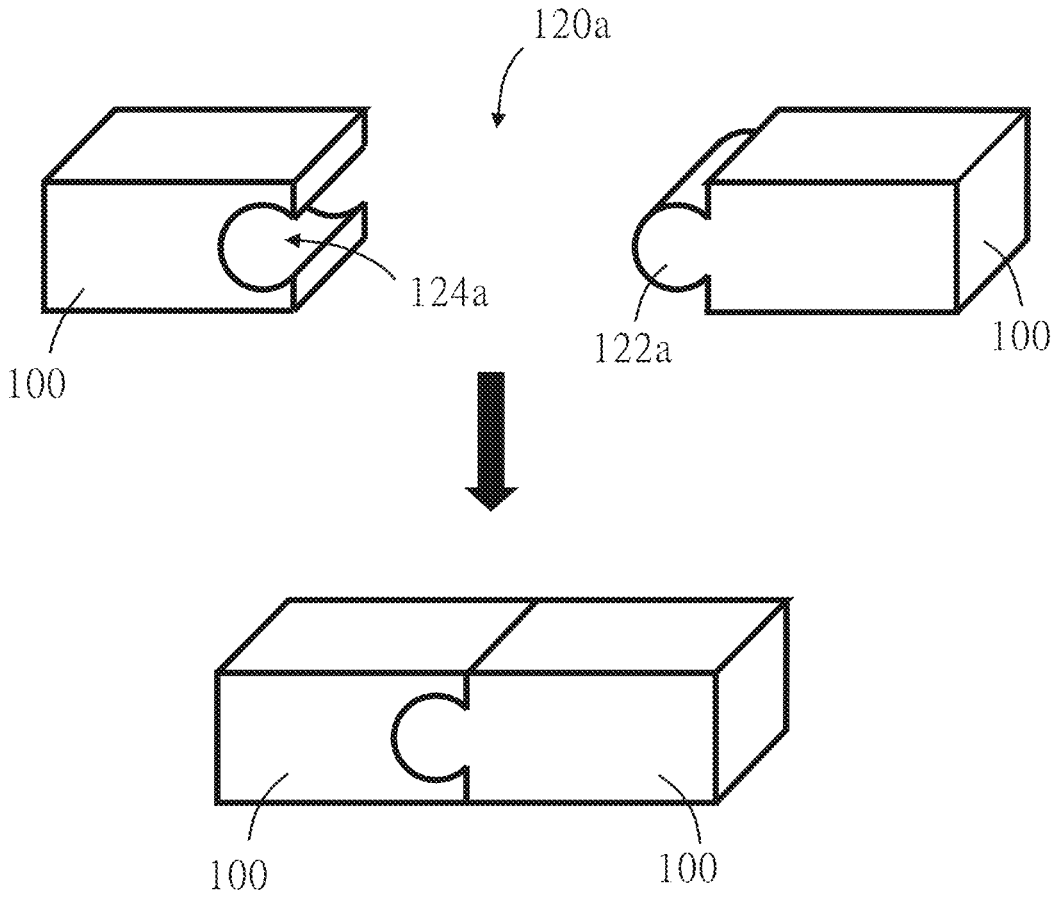
FIG. 6 is a schematic view of how to couple together two adjacent standard blocks shown in FIG. 1.

Referring to FIG. 6, there is shown a schematic view of how to couple together two adjacent standard blocks shown in FIG. 1. As shown in FIG. 6, the standard blocks 100 each have a jointing structure 120*a* for connecting the two adjacent standard blocks 100. The jointing structures 120*a* of the two adjacent standard blocks 100 are each a rail. One of the two standard blocks 100 has a slider 122*a*, and the other standard block 100 has a groove 124*a* corresponding in position to the slider 122*a*. Therefore, when the slider 122*a* is inserted into the groove 124*a* and moved in the extension direction of the groove 124*a*, the two standard blocks 100 not only get connected to each other but also get engaged with each other in the jointing direction. When the users want to demount one of the standard blocks 100 for replacement or washing, all the users need to do is slide the two standard blocks 100 relative to each other in the extension direction of the groove 124*a*, such that the two standard blocks 100 get disengaged from each other, easily and conveniently.

Figure 7:
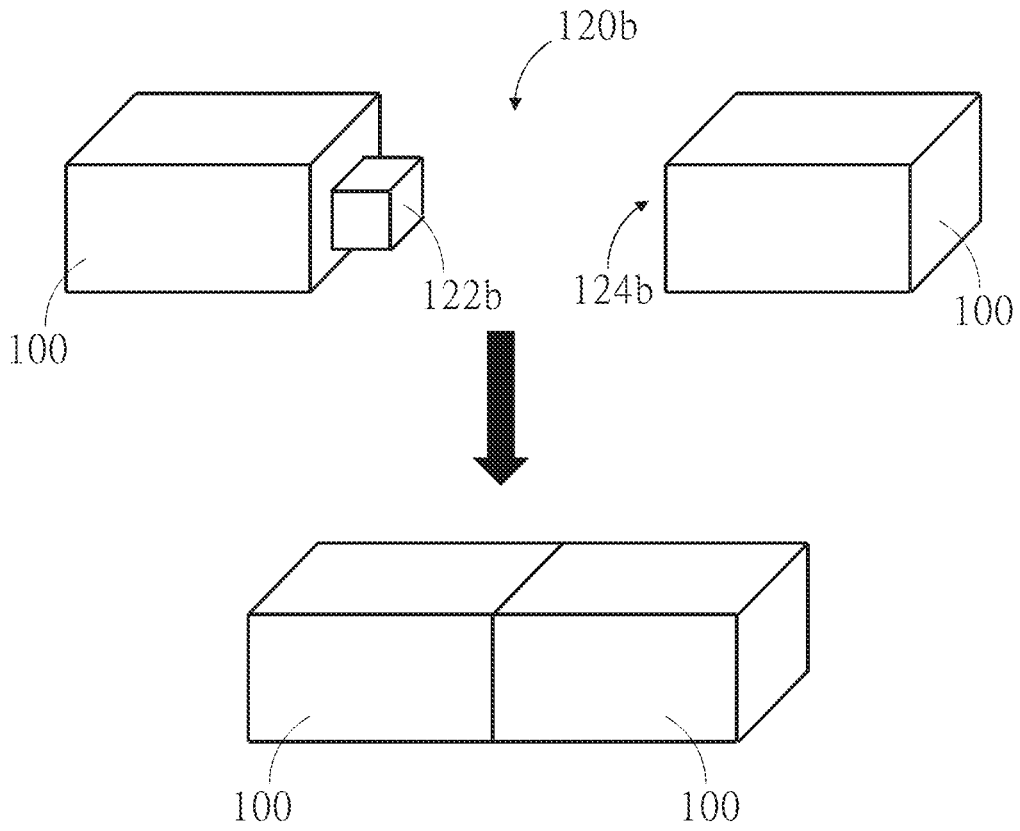
FIG. 7 is a schematic view of how to couple together two adjacent standard blocks in another embodiment of the support element assembly of the disclosure.

Referring to FIG. 7, there is shown a schematic view of how to couple together two adjacent standard blocks in another embodiment of the support element assembly of the disclosure. Unlike the standard blocks 100 of the embodiment illustrated by FIG. 6, the standard blocks 100 of the embodiment illustrated by FIG. 7 each have a jointing structure 120*b* provided in the form of a lock structure.

In this embodiment, one of the standard blocks 100 has a lock 122*b*, and the other standard block 100 has a slot 124*b* corresponding in position to the lock 122*b*. Therefore, when the lock 122*b* is inserted into the slot 124*b* and moved in the insertion direction, the two standard blocks 100 get connected to each other and get engaged with each other. To remove one of the standard blocks 100 for replacement or washing, the users only need to disengage the two standard blocks 100 by moving the two standard blocks 100 in the direction reverse to the insertion direction, thus separating the two standard blocks 100. Although the lock 122*b* and the slot 124*b* shown in FIG. 7 are of simple shapes, the lock 122*b* and the slot 124*b* can be of any other shapes as needed or even can have a fastening element or hooking portion with a specific insertion or engagement structure to fix the two standard blocks 100 to each other as needed, but the lock 122*b* and the slot 124*b* are not limited thereto.

Figure 8:
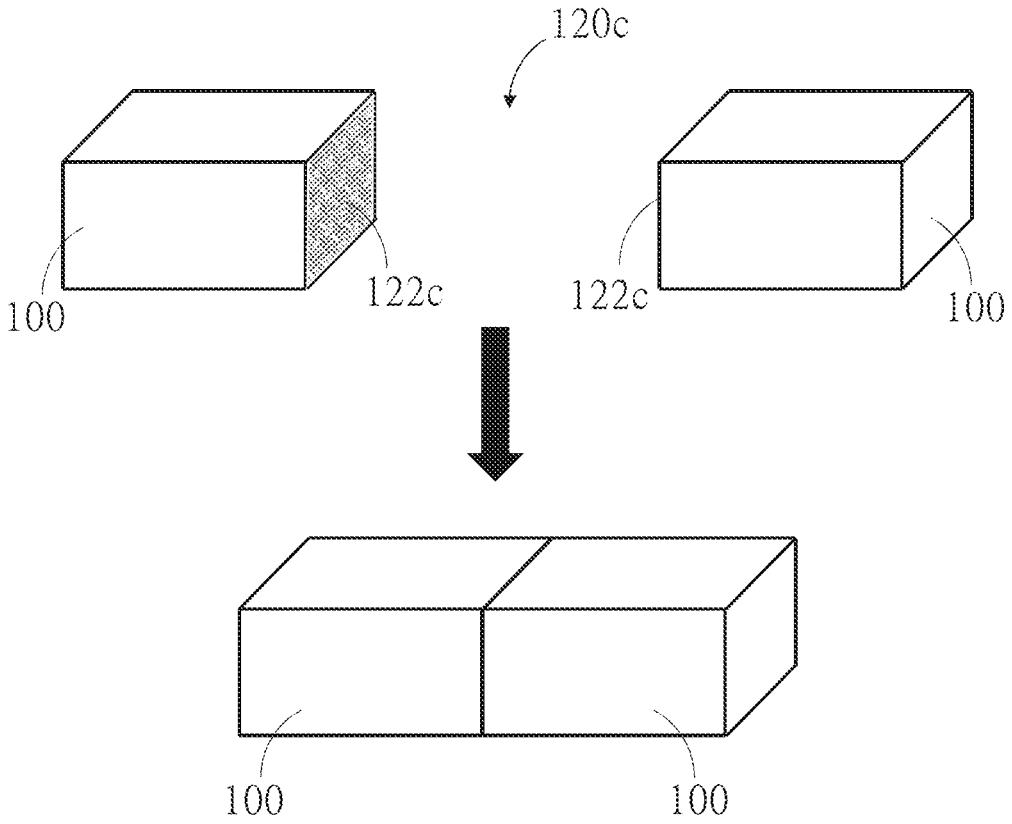
FIG. 8 is a schematic view of how to couple together two adjacent standard blocks in yet another embodiment of the support element assembly of the disclosure.

Referring to FIG. 8, there is shown a schematic view of how to couple together two adjacent standard blocks in yet another embodiment of the support element assembly of the disclosure. Unlike the standard blocks 100 of the embodiment illustrated by FIG. 6, the standard blocks 100 of the embodiment illustrated by FIG. 8 each have a jointing structure 120*c* provided in the form of a hook-and-loop fastener structure.

A hook-and-loop fastener 122*c* is selectively attached to at least a jointing-oriented surface of the standard block 100 during or after the process of production of the standard block 100. The hook-and-loop fastener 122*c* is, for example, a Velcro tape. Thus, two standard blocks 100 equipped with two hook-and-loop fasteners 122*c* of similar specification, respectively, can be temporarily fixed in place by pressing the two hook-and-loop fasteners 122*c* against each other by the user. To replace one of the standard blocks 100, the users pull the two hook-and-loop fasteners 122*c* apart, thereby achieving quick replacement of the standard blocks 100.

The disclosure is disclosed above by preferred embodiments. However, persons skilled in the art should understand that the preferred embodiments are illustrative of the disclosure only, but shall not be interpreted as restrictive of the scope of the disclosure. Hence, all equivalent modifications and replacements made to the aforesaid preferred embodiments shall be deemed falling within the scope of the claims of the disclosure. Accordingly, the legal protection for the disclosure shall be defined by the appended claims.

What is claimed is:

1. A support element assembly, comprising at least two types of standard blocks, wherein the at least two types of standard blocks are detachably connected to each other and wherein the at least two types of standard blocks are selected from a group consisting of:

a first standard block having a first elastic constant and a first height;

a second standard block having a second elastic constant and the first height;

a third standard block having the first elastic constant and a second height; and a fourth standard block having the second elastic constant and the second height, wherein the at least two types of standard blocks are manufactured by three-dimensional (3D) printing and have substantially identical lattices, and each of the at least two types of standard blocks has a jointing structure.

2. The support element assembly of claim 1, wherein the first elastic constant ranges from 3-15 N/mm.

3. The support element assembly of claim 1, wherein the second elastic constant ranges from 10-40 N/mm.

4. The support element assembly of claim 1, wherein a ratio of the first elastic constant to the second elastic constant ranges from 0.075-1.5.

5. The support element assembly of claim 1, wherein the first height equals an average distance between a top surface and a bottom surface of the first standard block or the second standard block, and the second height equals an average distance between a top surface and a bottom surface of the third standard block or the fourth standard block.

6. The support element assembly of claim 1, wherein an absolute value of a slope of an upper surface of the support element assembly is not greater than 0.75.

7. The support element assembly of claim 6, wherein the support element assembly is composed of a single layer of standard blocks in a height direction, the first height is less than the second height, and a difference between the first height and the second height is not greater than 75% of the second height.

8. The support element assembly of claim 1, wherein the lattices each have a lattice dimension of 8.5-10 mm.

9. The support element assembly of claim 1, wherein the lattices each have a lattice strut with a diameter of 0.9-1.0 mm.

10. The support element assembly of claim 1, wherein the jointing structure is one selected from a group consisting of a rail, a lock, a fastener, and a hook-and-loop fastener.

11. The support element assembly of claim 1, wherein the jointing structure comprises a groove defined on a first one of the at least two types of standard blocks and a slider defined on a second one of the at least two types of standard blocks, and a sidewall of the first one of the at least two types of standard blocks defining the groove surrounds more than 180 degrees of the slider.

12. The support element assembly of claim 1, wherein the jointing structure comprises a lock defined on a first one of the at least two types of standard blocks and a slot defined on a second one of the at least two types of standard blocks, the slot being configured to receive the lock such that a sidewall of the first one of the at least two types of standard blocks from which the lock protrudes abuts a sidewall of the second one of the at least two types of standard blocks into which the slot is defined.

13. The support element assembly of claim 1, wherein at least one of:

the jointing structure comprises a groove defined on a first one of the at least two types of standard blocks and a slider defined on a second one of the at least two types of standard blocks, and a sidewall of the first one of the at least two types of standard blocks defining the groove surrounds more than 180 degrees of the slider, or the jointing structure comprises a lock defined on the first one of the at least two types of standard blocks and a slot defined on the second one of the at least two types of standard blocks, the slot being configured to receive the lock such that the sidewall of the first one of the at least two types of standard blocks from which the lock protrudes abuts a sidewall of the second one of the at least two types of standard blocks into which the slot is defined.

14. The support element assembly of claim 1, wherein the support element assembly consists of two of the first standard block, the second standard block, the third standard block, or the fourth standard block.

15. The support element assembly of claim 14, wherein each of the two of the first standard block, the second standard block, the third standard block, or the fourth standard block has a planar top surface.

16. The support element assembly of claim 1, wherein the support element assembly comprises at least three types of standard blocks, and the at least three types of standard blocks are selected from a group consist of the first standard block, the second standard block, the third standard block, and the fourth standard block.

17. The support element assembly of claim 1, wherein the support element assembly comprises the first standard block, the second standard block, and the third standard block, and the second standard block is between the first standard block and the third standard block.

18. The support element assembly of claim 1, wherein the support element assembly comprises:

a plurality of the first standard blocks, and the second standard block surrounded on at least three sides by the plurality of the first standard blocks.

19. The support element assembly of claim 18, wherein the support element assembly comprises:

the fourth standard block, wherein at least one of the plurality of the first standard blocks is between the second standard block and the fourth standard block.

20. The support element assembly of claim 1, wherein each of the at least two types of standard blocks comprises extruded polyurethane.

* * * * *